United States Patent [19]

Hicks et al.

[11] 4,132,155

[45] Jan. 2, 1979

[54] PAPER CRAFT KIT

[75] Inventors: Alan A. Hicks, Chicago; Harry Disko, South Barrington, both of Ill.

[73] Assignee: Marvin Glass & Associates, Chicago, Ill.

[21] Appl. No.: 723,988

[22] Filed: Sep. 16, 1976

[51] Int. Cl.[2] ..... B31F 1/00; B31F 1/20

[52] U.S. Cl. ..... 93/1 G; 93/1 R; 93/84 R

[58] Field of Search ..... 93/1 G, 1 R, 1 WZ, 58 R, 93/58.2 R, 58.1, 60, 84 R; 83/500, 495

[56] References Cited

U.S. PATENT DOCUMENTS

| | | | |
|---|---|---|---|
| 182,670 | 9/1876 | Hood et al. | 83/500 |
| 472,928 | 4/1892 | Kieser | 83/500 |
| 1,804,642 | 5/1931 | Powell | 83/495 X |
| 1,958,459 | 5/1934 | Angeletti | 93/1 R |
| 2,404,941 | 7/1946 | Beckelman | 93/1 R |

*Primary Examiner*—James F. Coan

*Attorney, Agent, or Firm*—Mason, Kolehmainen, Rathburn & Wyss

[57] ABSTRACT

A kit or device which can be used by children to create artistic forms from sheets of paper. The kit includes a cutting portion which can be manually operated to cut strips from a sheet of paper and also a portion for creating corrugations and/or curls in paper, such as the cut strips. The cutting portion generally includes a plurality of cutting wheels mounted on separate horizontal parallel shafts for rotation therewith such that the side edges of the cutting wheels on the separate shafts are in cutting proximity with regard to each other. The cutting wheels are contained within an upstanding frame portion secured to a base. The spaced shafts are geared to each other so that manual rotation of one shaft is sufficient to rotate all cutting wheels. The frame portion has a side opening or slot at the cutting level so that a sheet of paper of any width can be accommodated during the cutting operation. A horizontally slidable or adjustable upstanding guide plate is provided to adjust the width of at least one strip of paper cut from the sheet or to eliminate the cutting of at least one strip.

7 Claims, 5 Drawing Figures

PAPER CRAFT KIT

BACKGROUND OF THE INVENTION

Field of the Invention

This invention relates to a device for producing decorative or artistic designs from a sheet or strip of paper.

Objective of the Invention

It is an object of this invention to meet the need and desire in the artistic crafts art to provide a device which can be used by a child or adult to cut paper into strips and form the strips of paper into artistic designs for use, for example, in decorating a substrate.

SUMMARY OF THE INVENTION

The present invention provides a kit for creating artistic forms from a flat sheet of paper. The kit includes a frame mounted on and secured to a base. Mounted on the frame is an operable system for cutting a flat sheet of paper into a plurality of individual strips. Also provided are means for forming the strips of paper which have been cut by the cutting system into non-flat, e.g., curled or corrugated, configurations. The forming means preferably are removably mounted in driven association with the cutting means.

While this invention is susceptible of embodiment in many different forms, there is shown in the drawings and will herein be described in detail a specific embodiment and modification thereof, with the understanding that the present disclosure is to be considered as an exemplification of the principles of the invention and is not intended to limit the invention to the embodiment or modification illustrated.

DESCRIPTION OF THE PREFERRED EMBODIMENT

Figure 1:
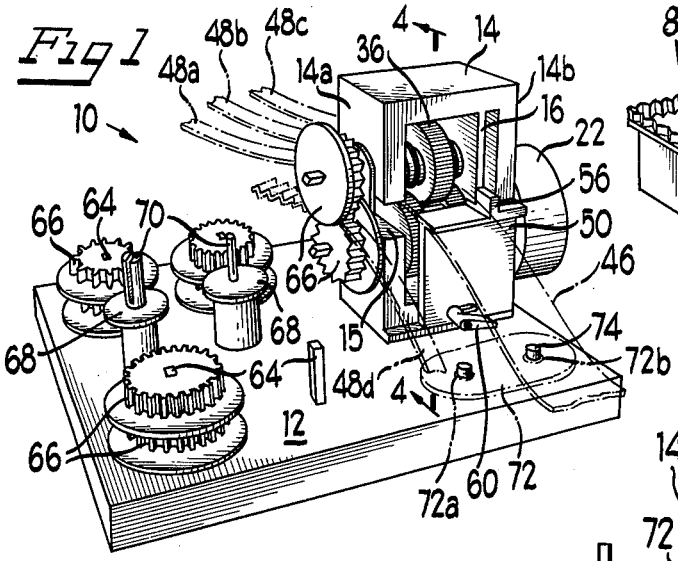
FIG. 1 is a perspective view of an embodiment of the paper cutting and forming device of this invention.

Turning first to FIG. 1, an embodiment of the device of this invention is identified generally by reference numeral 10. The device can be used by children as well as adults. Considering FIGS. 1 and 3 through 5, the device 10 has a base member 12 with an upstanding frame 14 secured thereto. Frame 14 has opposing upstanding walls 14*a* and 14*b*. Wall 14*a* is provided with a recess or gap 15 for a purpose to be described hereinbelow. Frame 14 also includes a vertical partition 16. A first shaft 18 and a second shaft 20 are mounted for rotation through vertical walls 14*a* and 14*b* and partition 16. A knob 22 (FIGS. 1, 3 and 4) is mounted and secured by a bolt 24 (FIG. 4) on one end of shaft 18 which protrudes beyond the wall 14*b*. A gear 26 (FIG. 4) is secured to shaft 18 enmeshed with a gear 28 (FIGS. 3 and 4) secured to shaft 20 for rotation therewith.

A cutting wheel 32 (FIGS. 3 through 5) also is secured to shaft 18 on the side of partition 16 opposite gear 26. A second cutting wheel 34 (FIGS. 3 and 4) is secured to shaft 18 on the side of a frame spacer portion 35 (FIG. 4) opposite the cutting wheel 32. An intermediate third cutting wheel 36 (FIGS. 1 and 3 through 5) is secured to shaft 20 between spacer sleeves 38 and 40 (FIGS. 3 and 4) which have peripheral O-rings 42 (FIGS. 3 through 5) in loose engagement with the teeth of gears 32 and 34 respectively for holding strips of paper therebetween and facilitating moving the paper through the device. Cutting wheels 32 and 34 sandwich cutting wheel 36 therebetween as seen in FIG. 4 so that the cutting edges of their treads engage the cutting edges of the tread of wheel 36. The edges of the side faces of the cutting wheels provide peripheral cutting edges.

Manual rotation of knob 22 rotates shaft 18 and gear 26 secured thereto which is enmeshed with gear 28 secured to shaft 20, thereby rotating shaft 20 in an opposite rotational direction with regard to shaft 18. Cutting wheels 32 and 34 rotate with shaft 18 and cutting wheel 36 rotates with shaft 20. During rotation, the knurled cyclindrical outer rims of cutting wheels 32 and 34 loosely engage the O-rings 42 on spacer sleeves 38 and 40. Thus, when a sheet of paper 46 (e.g., as depicted in phantom in FIG. 1) is fed into the device so that its leading edge engages the three cutting wheels 32, 34, and 36, it is pulled through the device and the sheet of paper is cut at the side cutting edges of the wheels to form three strips of paper shown at 48*a*, *b* and *c* (FIG. 1). Any overage in width of the sheet of paper 46 (as viewed to the left of FIGS. 1, 3 and 4) passes through slot or gap 15 as extra material which can be reprocessed through the device to make further strips.

A vertical plate 50 is slidably mounted with its bottom edge on an extending bottom ledge 52 (FIGS. 3 and 5) of frame 14 and has a top flange received in a slot 54 in frame 14. Plate 50 has a slot 58 (FIGS. 3 and 5) which extends laterally. A manually operable crank bolt 60 (FIGS. 1, 3, and 5) projects through slot 58 and is threaded into the base of frame 14 for locking the plate 50 in place against the frame.

Figure 3:
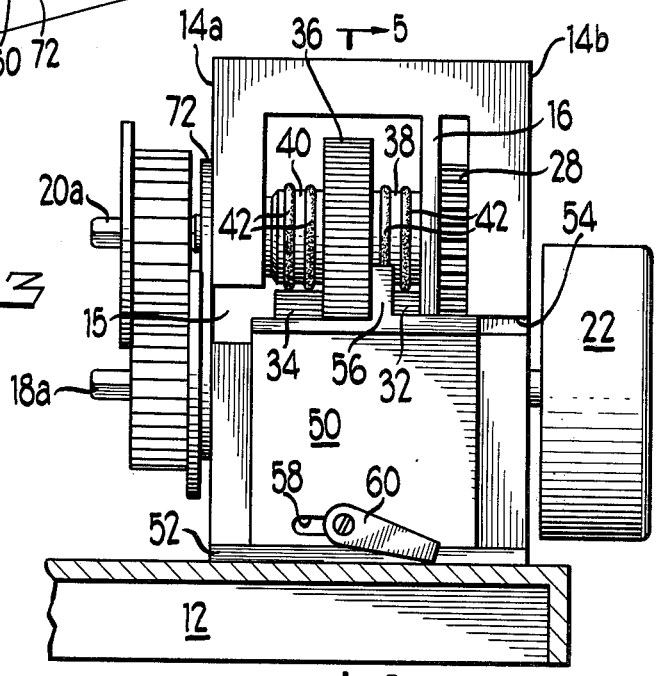
FIG. 3 is an enlarged fragmentary frontal view of the paper cutting and forming portions of the device of FIG. 1.
Figure 4:
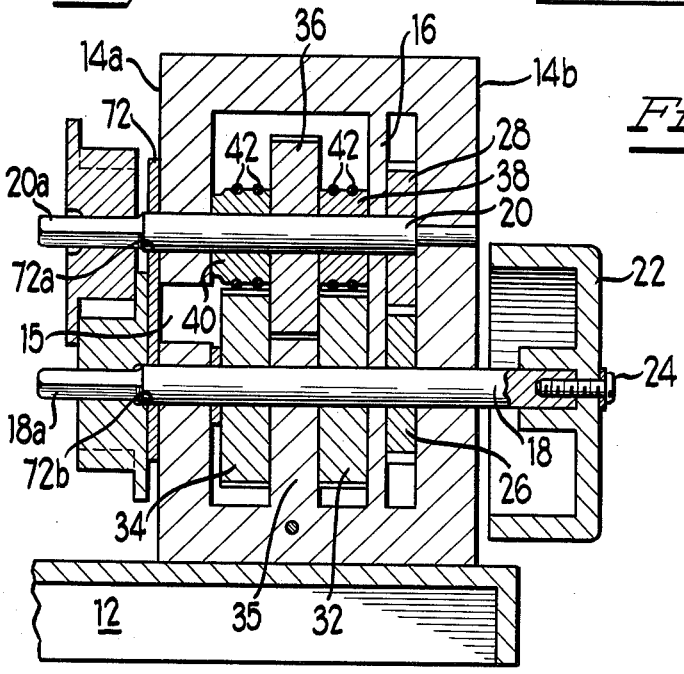
FIG. 4 is an enlarged fragmentary section taken generally along line 4—4 of FIG. 1.
Figure 5:
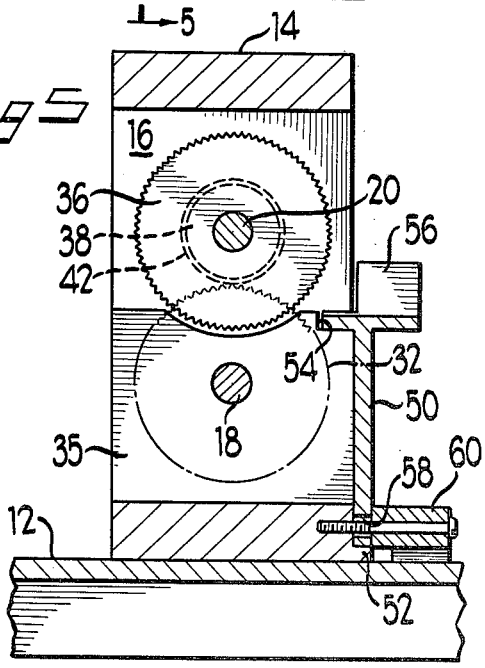
FIG. 5 is a section taken generally along line 5—5 of FIG. 3.

Secured to or a part of plate 50 is an upstanding guide portion 56 (FIGS. 1, 3 and 5). Upon loosening crank bolt 60, plate 50 can be moved laterally to the right or left as viewed in FIG. 3 carrying the upstanding flange or guide portion 56 therewith. In FIG. 3, the plate 50 is in its leftmost position with the guide portion 56 closely adjacent cutting wheel 36 so that when a sheet of paper is processed through the machine with the paper edge against guide portion 56, only two strips will be made since the contact of paper between wheel 32 and spacer 38 will be blocked by the guide 56. Plate 50 can be adjusted to the right from its position in FIG. 3 to permit cutting of a third strip of a predesired width depending upon the location of the guide 56. Each time after moving plate 50 to the desired position, crank bolt 60 is tightened to clamp the plate 50 in position.

The illustrated embodiment also includes means for shaping the cut paper strips into decorative, non-flat forms as by corrugating, knurling, curling, or the like. Accordingly, the shaft ends 18*a* and 20*a* protrude through vertical wall 14*a* and are square in cross-section (FIGS. 1, 3 and 4). A plurality of members such as corrugating wheels 66 and shaft extensions 68 are slidably removably receivable on the square shaft ends 18*a* and 20*a*.

The wheels 66 are provided in pairs having gear-like corrugations or knurled cylindrical toothed surfaces which intermesh when a pair of the wheels 66 are mounted on the shaft ends 18*a* and 20*a*. The central bore or hole through each of the wheels is square in configuration to fit the shaft ends 18*a* and 20*a* and to be driven with the shafts upon rotation so that when a strip of paper, e.g., 48*d* (FIG. 1), is fed therebetween, the strip of paper emerges corrugated. The spacing of the teeth on the various pairs of wheels 66 determines the configuration of the corrugation.

The shaft extensions 68 likewise are removably mountable on either of shaft ends 18*a* or 20*a* and have end slots 70 for receiving a strip of paper (e.g., produced by the cutting portion of the device). When knob 22 is rotated, the strip of paper will be wrapped around the end of the shaft extensions 68 and curled to give it a non-flat decorative appearance. Manual tension normally is applied to the loose end of the strip of paper during the curling operation to assure a tight curl around the shaft extension 68.

The wheels 66 and shaft extensions 68 can be stored conveniently by sliding fit on posts 64 upstanding from base member 12.

As described above, a gap is provided in wall 14*a*. This is done to accommodate sheets of paper which are wider than the width of the cutting area as determined by the location of guide 56. Such a gap could permit bending of the frame 14 to an undesirable extent and eliminate a well-balanced, parallel association between shafts 18 and 20 during use of the corrugating wheels. An anti-expansion plate 72 (FIGS. 1, 3 and 4) is provided having properly spaced bores 72*a* and 72*b* (FIGS. 1 and 4) for slidable mounting on shafts 18 and 20 adjacent their square ends 18*a* and 20*a*. Plate 72 retains the shafts 18 and 20 against movement from parallel condition which may occur due to even slight resiliency of the material of frame 14. Of course, plate 72 would be removed during a cutting operation where a wide sheet of paper is used which protrudes outwardly edgewise from gap 15. For purposes of storing plate 72 along with the remainder of the device, a pair of upstanding lugs 74 are provided on base 12 for receiving the pair of bores 72*a* and 72*b* in plate 72.

Referring to the corrugating wheels 66 in greater detail, the wheels are provided for use in pairs and can be stored in pairs over the upstanding rectangular shaft 64 on top of the base member 12. Each pair of wheels has differently shaped, complementary teeth about the periphery thereof to form differently shaped corrugated strips of paper. More particularly, the pair of corrugating wheels 66 shown in FIG. 1 mounted on the frame 14 have complementary meshing teeth which are triangularly shaped with no spacers therebetween to form a corrugated paper strip as shown in FIG. 1. The pair of corrugating wheels 66 shown stored at the front lefthand corner of FIG. 1 on top of the base member 12 have teeth about the periphery thereof which are spaced apart by flat areas of the wheels at the root of the teeth, and the teeth terminate in flat land areas at the peripheral extremities thereof. The pair of corrugating wheels 66 shown at the rear lefthand corner of the base member 12 in FIG. 1 have pointed teeth which are spaced apart by flat areas of the teeth in the root area thereof. The pair of corrugating wheels 66 shown to the right as stored at the rear of the base member 12 in FIG. 1 have teeth terminating in flat land areas, but with rounded spacings between the teeth.

The shaft extensions 68, two of which are shown stored on top of the base member 12 in FIG. 1, also may be provided of different shapes or sizes for different effects in forming the paper strips. For instance, the righthand shaft extension shown on top of the base member 12 in FIG. 1 would form a tighter curl in the paper strip than the shaft extension 68 shown to the left in FIG. 12.

Figure 2:
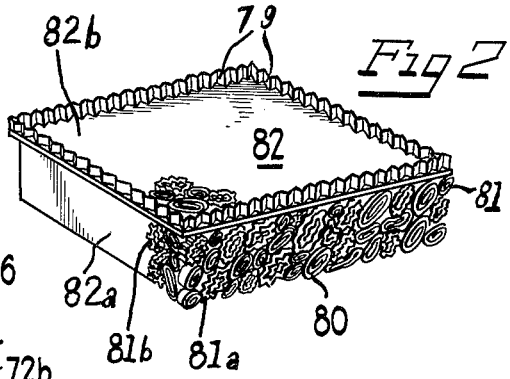
FIG. 2 is a perspective view of an article partially decorated with paper cut and formed using the device of FIG. 1.

Referring to FIG. 2, and article 82 in the form of a box having a lower portion 82*a* and a lid portion 82*b* is shown partially decorated with different formed paper strips from the device of the present invention. For instance, the top peripheral edge of the lid portion 82*b* has straight strips 79 of corrugated paper secured thereto, as by an appropriate adhesive, the strips being formed by the corrugated wheels 66 shown in place on the upstanding frame 14 in FIG. 1. The sides of the lower portion 82*a* of the box 82 and the top surface of the lid portion 82*b* are shown partially decorated by curled strips of paper formed by the corrugating wheels 66 and shaft extension 68. More particularly, a curled strip 80 on the front side of the box could be formed by the lefthand shaft extension 68 shown in FIG. 1. A more tightly wound strip of paper 81 is shown secured to the front of the box as formed by the righthand shaft extension 68 shown in FIG. 1. Another curled strip of paper 81*a* is shown secured to the front of the box in FIG. 2, as formed by curling a strip of paper 79 as formed by the corrugating wheel 66 positioned on the frame 14 in FIG. 1. Another corrugated strip as formed by the lefthand front pair of corrugating wheels as shown in FIG. 1 is curled and secured to the side of the box 82, as at 81*b*. It can be seen that a wide variety of uses for decorating purposes or creative art is afforded by the kit of the present invention and the resulting configurated paper strips formed thereby.

The foregoing detailed description has been given for clearness of understanding only and no unnecessary limitations should be understood therefrom as some modifications will be obvious to those skilled in the art.

We claim:

1. A kit for creating artistic forms from a sheet of paper, or the like, comprising:

a frame member;

means on said frame member for cutting at least one individual strip from said sheet of paper, said cutting means including a first shaft mounted on the frame for rotation relative thereto in a first cutting wheel on said first shaft, and a second shaft mounted on said frame member having a second cutting wheel mounted thereon for rotation therewith in proximity to said first cutting wheel wherein at least one of said first and second shafts extends exteriorly of said frame forming a shaft end protrusion;

means mountable on said shaft end protrusion for deforming the paper strip into a non-flat configuration; and drive means for rotating said first and second shafts.

2. The kit of claim 1 wherein both of said shafts extend exteriorly of an upright support member thereby forming spaced shaft end protrusions and including a plurality of removably mountable corrugating wheel members for mounting on said shaft end protrusions for rotation with said shafts, said corrugating wheel members being so sized to fit in meshed proximity with each other for receiving strips of paper retrieved from said cutting means therebetween, whereby upon rotating said first shaft while feeding a strip between said corrugating wheel members, the strip is corrugated.

3. The kit of claim 1, including shaft extension means removably mountable on said shaft end protrusion for rotation therewith and having slotted terminal distal end means for receiving a strip of paper produced by said cutting means edgewise for curling the strip responsive to rotation of said first shaft.

4. A kit for creating artistic forms from a sheet of paper, or the like, comprising:

a frame member, means on said frame member for cutting at least one individual strip from said sheet of paper, means on said frame member for forming the paper strip into a non-flat configuration, and manually operable drive means on said frame member for driving said cutting means and said forming means, wherein said forming means includes a shaft member on said frame having a shaft end protrusion, and means removably mountable on said shaft end protrusion for rotation therewith and having a slotted terminal distal end means for receiving a strip of paper produced by said cutting means edgewise for curling the strip responsive to rotation of said first shaft.

5. A kit for creating artistic forms from a sheet of paper, or the like, comprising:

a frame having a pair of support members, means on said frame for cutting at least one strip from said sheet of paper, said cutting means including a first shaft mounted between said support members for rotation relative thereto, a first cutting wheel on said first shaft for rotation therewith and having means defining a cutting edge, a second shaft mounted between said support members for rotation relative thereto, a second cutting wheel on said second shaft for rotation therewith and having means defining a cutting edge in proximity to the cutting edge of said first cutting wheel;

means on said frame for deforming the paper strip into a non-flat configuration;

manually operable drive means on the frame for driving said cutting means and said deforming means;

horizontal gap means in and extending the width of one of said support members between said shafts at the cutting area level of said cutting wheels for accomodating a sheet of paper wider than the distance between said support members; and a removable anti-expansion plate and means for removably securing the anti-expansion plate on said one support member spanning said gap means to prevent expansion of said gap means.

6. A kit for creating artistic forms from a sheet of paper, or the like, comprising:

a frame having a pair of support members, means on said frame for cutting at least one strip from said sheet of paper, said cutting means including a first shaft mounted between said support members for rotation relative thereto, a first cutting wheel on said first shaft for rotation therewith and having means defining a cutting edge, a second shaft mounted between said support members for rotation relative thereto, a second cutting wheel on said second shaft for rotation therewith and having means defining a cutting edge in proximity to the cutting edge of said first cutting wheel;

a sleeve mounted on said second shaft for rotation therewith, said sleeve being in alignment with the cutting wheel on said first shaft with means engageable therewith to facilitate feeding of paper between the cutting wheels;

means on said frame for deforming the paper strip into a non-flat configuration; and manually operable drive means on the frame for driving said cutting means and said deforming means wherein the cutting wheel on said second shaft has a knurled tread and the sleeve has a cylindrical outer surface engaging said tread while permitting slippage between the sleeve and tread.

7. A kit for creating artistic forms from a sheet of paper, or the like, comprising:

a frame member, means on said frame member for cutting one or more individual strips from said sheet of paper, means on said frame member for deforming the paper strip into a non-flat configuration, and manually operable drive means on said frame member for driving said cutting means and said deforming means, wherein said deforming means includes a pair of spaced shaft members on said frame with adjacent shaft end protrusions extending exteriorly of the frame, said deforming means including a plurality of removably mountable corrugated wheel members for mounting on said shaft end protrusions for rotation therewith, said corrugated wheel members being so sized to fit in meshed proximity with each other for receiving strips of paper retrieved from said cutting means therebetween, whereupon rotating said shafts while feeding a strip between said corrugated wheel members, the strip is corrugated.

* * * * *